US007905790B2

(12) United States Patent
Schnuckle

(10) Patent No.: US 7,905,790 B2
(45) Date of Patent: Mar. 15, 2011

(54) THEME PARK RIDE WITH RIDE-THROUGH SCREEN SYSTEM

(75) Inventor: Gary W. Schnuckle, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 366 days.

(21) Appl. No.: 12/204,917

(22) Filed: Sep. 5, 2008

(65) Prior Publication Data

US 2010/0062866 A1 Mar. 11, 2010

(51) Int. Cl.
*A63G 1/34* (2006.01)
*A63G 1/00* (2006.01)

(52) U.S. Cl. ..... 472/43; 472/59

(58) Field of Classification Search ..... 472/43, 472/57–61, 75–83, 130; 434/29, 55, 62, 434/63, 67

See application file for complete search history.

(56) References Cited

U.S. PATENT DOCUMENTS

| | | | | |
|---|---|---|---|---|
| 1,098,711 | A * | 6/1914 | Clarke | 83/882 |
| 1,260,900 | A * | 3/1918 | Hartwick | 472/76 |
| 3,625,510 | A * | 12/1971 | Szigety | 472/75 |
| 3,754,756 | A * | 8/1973 | Szigety | 472/75 |
| 3,831,847 | A | 8/1974 | Serritella | |
| 3,965,613 | A | 6/1976 | Saunders | |
| 4,486,729 | A | 12/1984 | Lee | |
| 4,726,503 | A * | 2/1988 | Bowker | 226/188 |
| 5,370,430 | A | 12/1994 | Mozafari | |
| 5,669,821 | A | 9/1997 | Prather et al. | |
| 5,971,451 | A | 10/1999 | Huang | |
| 6,254,489 | B1 * | 7/2001 | Drobnis et al. | 472/65 |
| 6,309,306 | B1 * | 10/2001 | Geagley et al. | 472/60 |
| 6,565,147 | B1 | 5/2003 | Beals, Jr. | |
| 6,796,908 | B2 * | 9/2004 | Weston | 472/43 |
| 7,740,359 | B2 * | 6/2010 | Schnuckle et al. | 353/79 |
| 2006/0214756 | A1 | 9/2006 | Elliott et al. | |

FOREIGN PATENT DOCUMENTS

| | | |
|---|---|---|
| JP | 55119542 | 9/1980 |
| JP | 4007483 | 1/1992 |

* cited by examiner

*Primary Examiner* — Kien T Nguyen
(74) *Attorney, Agent, or Firm* — Marsh Fischmann & Breyfogle LLP; Kent A. Lembke

(57) ABSTRACT

A vehicle and screen assembly is provided for theme park rides to create a ride-through screen experience. The assembly includes a vehicle for carrying passengers that includes a top or roof assembly with first and second sets of magnetic elements on an exterior surface of the top assembly, with each of the sets having a like pole oriented outward from the exterior surface. A screen assembly is included with first and second planar screen segments that are pivotably mounted adjacent to each other so as to hang or be positioned in a plane that is transverse to a track traveled by the vehicle. The screen segments include magnetic elements with exposed poles that match the outward facing pole of the corresponding sets of magnetic elements on the vehicle. The screen segments magnetically levitate away from the top assembly when the vehicle passes through the screen assembly without touching the vehicle.

20 Claims, 13 Drawing Sheets

THEME PARK RIDE WITH RIDE-THROUGH SCREEN SYSTEM

BACKGROUND OF THE INVENTION

1. Field of the Invention

The present invention relates, in general, to theme or amusement park rides with video or projected images, and, more particularly, to ride designs that use vehicles to move passengers through a themed attraction or ride with show portions and that use doors or other devices to separate and/or isolate various segments of the ride or show (e.g., to block light and/or sound from traveling along a track with the passenger vehicles or to prevent or minimize mixing of ride or show segments).

2. Relevant Background

Millions of people visit amusement parks each year, and park operators seek rides to attract new and returning visitors to their parks including rides that make their parks unique compared with their competitors' parks. In theme and other amusement parks, most attractions utilize vehicles even when the attraction is a walk-through or slower ride because vehicles or people movers are useful for delivering entertainment to large numbers of guests (e.g., some rides have theoretical capacities of hundreds and even thousands of guests per hour) and maintain throughput or flow of the guests or passengers through the rides. Many rides include a slower portion or segment to allow them to easily provide a "show" in which animation, movies, three-dimensional (3D) effects and displays, audio, and other effects are presented in a carefully timed or synchronized manner to vehicles proceeding through such show portions. The show portions of rides are often run or started upon sensing the presence of a vehicle and are typically designed to be most effective when vehicles travel through the show portion at a particular speed such as several feet per second (or a typical walking pace or somewhat faster or slower).

In a typical show or theme ride, guests or passengers may walk into and through a pre-show area (e.g., a queue or waiting area) in which video or other effects such as animatronics are used to introduce the story or show to be provided during the ride. The guests then enter a loading area where they are loaded into a series of vehicles or people movers. The vehicles, which may be attached to a drive chain or cable, are moved along a track that is divided up into a number of show segments or portions. Some rides include video effects such as three-dimensional (3D) videos, and images are projected upon screens that are typically positioned along the walls or ceilings near the moving vehicles. To provide better viewing of these displayed images, the vehicles may be complex and costly such as vehicles with many moving parts and degree of freedom (DOF) motors to rotate the vehicle to view screens to the left or to the right of the moving vehicle. Vehicles may also include doors, roofs, and/or windows to direct the guests to view in a particular direction or to provide limited, directed line of sight toward show aspects. The projected images are preferably closely synchronized to the location and rate of travel of the vehicles, and this may require numerous sensors to determine the location of the vehicles and controllers to precisely start and stop projection of images based on sensed vehicle locations. For rides with 3D projected video, the passengers may also be given 3D glasses to wear. The show effects may also include animatronics and a set to add to the 3D effect or realism of displayed images.

It is typically desirable to separate the various show segments or portions to isolate the audio and lights associated with each segment to a particular length of the track, e.g., such that passengers can only see one show segment at a time. Rides may be configured to provide show segmentation and isolation by providing a circuitous path for the track with differing show segments provided in different "rooms" or along various lengths of track that may be separated by a bend or two in the track. Such an open track design may not prevent sounds and lights from traveling between these "rooms" or sections of the track especially in particularly loud shows or ones with bright lighting effects or displays. The bleed over or mixing of show segments may ruin the show effect for lead or trail vehicles or at least detract from the overall ride enjoyment for some of the guests.

To better isolate various show segments, the ride design may include doors or other barriers between neighboring show segments. For example, a door (e.g., a show action door) may be provided in a show tunnel that is operated to open to allow a series of vehicles to move from one show segment or room to another and then operated to close. The door may be a two-part door with each side or half hung on hinges and moved or swung open with hydraulic devices in response to a sensor detecting an approaching vehicle. The show action doors are desirable within the attraction for defining and isolating the individual scenes and for controlling light and sound. Unfortunately, these action doors may be expensive to design, install, and maintain due to the mechanical drive systems and electronic and optical sensors and/or control elements. Further and in some cases more importantly, existing show action doors are often undesirable because opening and closing them can be too loud, e.g., the hydraulic actuators used to open and close the doors typically generate noises that are heard by passengers in the vehicles that may distract the passengers from the show features and these noises are difficult to mask.

Hence, there remains a need for theme ride designs that provide effective ways to separate one show or ride segment from another and that support display of video images. Preferably, such ride designs would provide a very quiet way of isolating the show segments to limit distractions that may effect a passenger's or guest's enjoyment of a theme ride or ride with a show portion.

SUMMARY OF THE INVENTION

The present invention addresses the above problems by providing vehicle and screen assemblies that are adapted to provide touch free (or no contact) ride-through screen experiences in theme or amusement park rides. In this regard, a "screen" is considered any movable or pivotable show or scenic element that may be positioned in a vehicle's path. To this end, a vehicle may be equipped with a number of levitation rails that extend over a curved exterior surface of a vehicle. Each of these rails may be used to house a plurality of permanent magnets with like poles oriented outward or toward an exterior surface of the rail. A screen, door, animatronic figure, or other scenic element may be placed across or orthogonal to a track traveled or followed by the vehicle, and the screen may be segmented or include a number of segments similar to triangular wedges of a pie, be a side-by-side door arrangement, be a single mural or projector screen, or the like. Each screen segment is mounted with a hinge or other pivoting mount on a side of the body (e.g., triangle's base, rectangular door's edge, or the like). To provide magnetic levitation, one or more permanent magnets is placed in the tip of the segment body with a like pole as those in an aligned or corresponding levitation rail on the vehicle. Hence, as the vehicle passes through the closed screen, the screen segments are levitated away from the levitation rails by mutually repulsive or repelling magnetic forces, with the shape and length of the levitation rail or series of magnets being chosen to trace or approximate the swing or travel path of the magnets in the tips/edges of the screen segments as the segments rotate about their bases or mounted edges. In this manner, embodiments of the invention provide a screen actuating vehicle along with a passive screen in a ride path that may be used for displaying projected images as well as providing sound and light control to better define portions of a themed ride or attraction.

More particularly, an assembly is provided for use with a vehicle track of a ride system in a theme or amusement park to create a ride-through screen experience. The assembly includes a vehicle for carrying passengers that has a base adapted for mating with or riding on the vehicle track and, typically, for seating the passengers. The vehicle also includes a top or roof assembly with first and second sets of magnetic elements on an exterior surface of the top assembly, with each of the sets having a like pole oriented outward from the exterior surface. The assembly further includes a screen assembly with first and second screen segments (e.g., planar fabric sheets or the like that are pivotably mounted adjacent to each otherThe so as to hang or be positioned in a closed position for the screen assembly) that are transverse or, in some cases, orthogonal to the vehicle track. The first and second screen segments each include a magnetic element with an exposed pole that matches the outward facing pole of the corresponding or paired one of the sets of magnetic elements on the vehicle. During operation, the first and second screen segments are magnetically levitated away from the top assembly when the vehicle passes through the screen assembly on the ride track without the segments touching the vehicle.

The magnetic elements of each set may be permanent magnets that are arranged along a length of a levitation rail that is provided in the top assembly. The screen segments may have a body with a triangular shape (such as an isosceles triangle), and the magnet elements of the screen segments are provided in a tip that is distal to a base side of the triangular body. The levitation rails may then have a curved geometry or shape that is selected based on or to trace a swing or travel path followed by the corresponding one of the screen segment magnetic elements as the screen segment is rotated about the pivotable or hinged mount, e.g., about the base of the triangular body. The body may be formed of a material(s) to provide a projection surface for displaying a video image projected from one or more projectors. The screen assembly may also include third and fourth screen segments mounted adjacent the first and second segments, with these two segments also being triangular in shape and including a magnetic element in or near their tips. In this case, the vehicle will typically include third and fourth levitation rails that are arranged to be aligned (and their housed magnets) with the magnetic elements of one of the screen segments.

For example, the magnetic elements may be a plurality of permanent magnets (such as rare earth magnets) aligned within about 0.25 inches of the swing path of the corresponding screen segment magnets that are linearly arranged with a spacing between neighboring magnets of less than about 0.125 inches. The top assembly may include a flexible cover that extends between at least two of the levitation rails and one or more of the levitation rails may be positionable (e.g., rotated about its mounting points or the like) in a closed position and in an open position in which passengers may enter and exit the vehicle. The screen segments may close or return to the original or transverse plane passively under forces of gravity and/or return mechanisms may be provided as part of or separately to the mounting assembly to apply a force to the body of the screen segments to return them to the original position across the vehicle track or vehicle travel path.

DETAILED DESCRIPTION OF THE PREFERRED EMBODIMENTS

Figure 1:
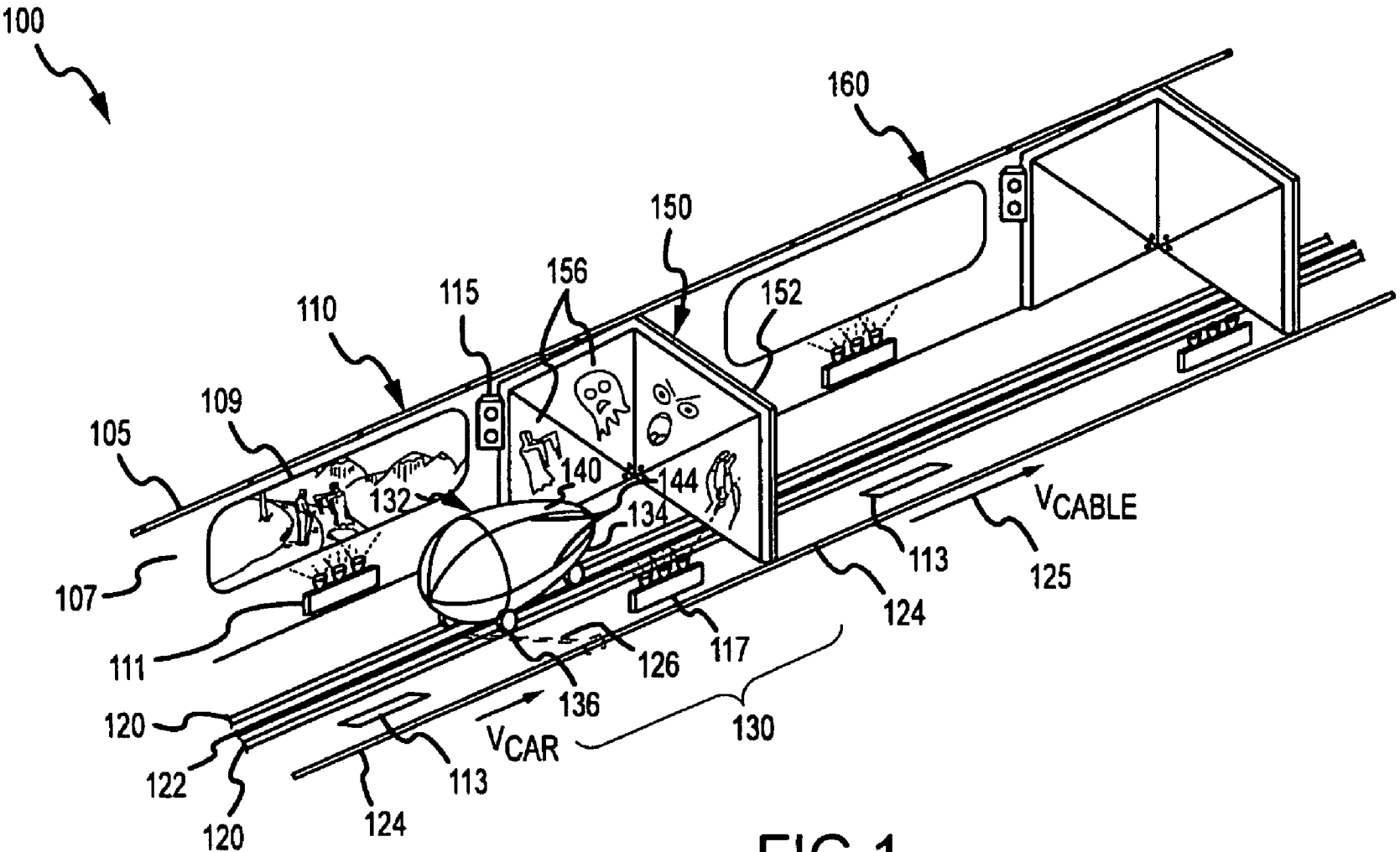
FIG. 1 is a partial perspective view (and partial cutaway) illustrating a theme ride adapted with a vehicle-screen assembly of an embodiment of the invention configured to provide a drive or ride-through screen that is moved or actuated by the vehicle without use of dedicated sensors and screen actuators.

Briefly, embodiments of the present invention are directed to systems, and associated methods, for theme or amusement park rides that provide a ride with show portions and a drive or ride-through screen. In some embodiments, the ride-through screen is also used as a projection screen such as for a video projection surface. The ride-through screen may be segmented with each segment rotating about its base or mounting end and including an actuator member at its tip (e.g., at its point when the segments are triangular in shape). The ride also includes a vehicle that is configured to actuate and/or move the ride-through screen (e.g., the vehicle and screen make up a vehicle/screen assembly of the invention).

The vehicle is driven by a drive system such as a cable or chain drive or other useful drive arrangement for rides along a track that causes the vehicle to pass through a frame supporting the screen segments such as on hinges or similar mounts.

In one preferred embodiment, magnetic levitation is used such that the vehicle passes through the screen without contact (i.e., touch free) with screen segments. In this embodiment, the vehicle includes a top, cover, or roof with two or more levitation rail assemblies. Each such assembly includes an elongate, curved (or arcuate) rail extending over the vehicle top, which also is typically curved in shape (e.g., generally elliptical or spherical in shape or, in some cases, the vehicle body may be relatively egg-shaped with a shorter, wider base and a longer, more pointed front end corresponding to the trailing and leading ends of the vehicle while other cases may have a spherical vehicle body). The rail includes a groove or recessed surface along its length for receiving a series of magnets such as strong permanent magnets that are disk or circular in shape, are bar shaped, or other shapes, with each of the magnets being arranged with a same or like pole directed upward or outward from the rail (e.g., north or south poles facing out of the recessed surface).

In this embodiment, each of the segments of the screen includes at least one magnet near the tip or an edge (or an exposed portion) with the pole selected such that as the vehicle's rail approaches the screen magnetic repulsion of the screen magnets by the rail magnets causes the screen segments to be actuated (e.g., the magnet in the screen tip or edge acts as the actuator member of the tip or edge) or to be levitated away from the passing vehicle. The number of rails is selected to match the number of screen segments, and the location and shape of the rails is selected to align the series of magnets in the rail with the magnet(s) in the tip or edge at least at initial contact but more typically along the entire length of the rail or vehicle body so as to cause the screen segments to float over the top of the vehicle's outer surface. In other embodiments, the actuator member in the segment tip or edge/side is a roller that contacts the rail surface and rolls along the vehicle roof as the vehicle passes through to the next room or portion of the ride. After the vehicle passes through, the screen segments are returned to a closed position (e.g., each segment may be mounted on hinges and may return to a closed position due to the forces of gravity and/or counterweights may be provided to assist gravity (or for more horizontally mounted segments)), and, in the case of magnetic actuator members, the tips or edges of the screens/doors may be held together or in proximity (at least with a small amount of force) by the magnetic fields of the adjacent magnets.

FIG. 1 illustrates a ride system 100 of an embodiment of the present invention that includes a vehicle and screen assembly 130 that is uniquely adapted to provide a ride-through screen effect or operation mode. The inventor understands that in theme and amusement parks that the people mover or ride vehicle remains an important tool for delivering entertainment rapidly to many guests. To this end, the ride system 100 includes a vehicle or car 132 with a base 134 riding on wheels or casters 136, and the vehicle 132 is adapted for receiving or carrying 1, 2, or more passengers or guests in the ride system 100. Also, it is desirable in many attractions or themed rides with show elements to provide show action doors to define individual scenes, to control lighting and sound, and to present a scenic imagery. To this end, the ride system 100 includes one or more screen assembly (or show action door assembly) 150 that separates a first scene or room 110 of the ride system 100 (or a tunnel) from a second scene or room 160.

The vehicle and screen assembly 130 may be thought of as combining the separate functions of a people mover and show action door into a single assembly or system with a master and slave relationship. The ride vehicle 132 is a dual-purpose component that provides show delivery (e.g., moving people through or to a show in ride system 100) and also provides show activating. Regarding the show activating function, the vehicle 132 functions itself to actuate or move the screen 150 rather than requiring the ride system 100 to include a number of vehicle sensors that are used to trigger noisy hydraulic actuators to operate a show action door. The screen assembly 150 is a passive component of the assembly 130 and is typically provided in relatively simple form (e.g., screen material mounted to rotate about hinged mounts or the like), which eliminates much of the mechanics and controls to reduce fabrication and maintenance costs. In some cases, the fabrication and operating costs of such a passive screen 150 are low enough that the ride may include many of such screens within one attraction or ride system 100, which allows the screens 150 themselves to be incorporated into the show to become a featured element to entertain the passengers of the vehicle 132.

As shown, the ride system 100 is adapted for a theme-type ride in which various show scenes or portions are provided in a series of rooms 110, 160. The ride system 100 may include a show wall 107 (e.g., a tunnel defined by two sidewalls and a ceiling/roof) extending along (and around in some cases) a ride track 120 that may include one or more rails or other components used to guide a vehicle 132 along a path through the ride system 100. A show including video and audio and other display components may be provided in the ride system 100. For example, as shown, a projection screen or surface 109 may be provided on the wall 107 of room 110 and video projection equipment 111 may be activated to display a scene or portion of a show to the vehicle 132 (e.g., in response to sensing of the location of the vehicle 132 within the room 110 by sensors 113). The show may also include audio from speakers and/or other audio equipment 115, and, of course, nearly any display devices such as high definition displays may be used for display screen 109 and projection device 111 (which may, instead, be incorporated in device 109 such as in a rear projection device, in a crystal display, or other device).

In some embodiments, the ride-through screen assembly 150 is also used as a video screen or display. As shown, the assembly 150 may include a frame (or mounting structure) 152 that supports and positions two or more screen segments 156 to separate room 110 from adjacent or neighboring room 160 defined by wall or tunnel 107. Specifically, the screen segments 156 are positioned or hung such that they are blocking or across/transverse to the path of the vehicle 132 in the ride assembly 100. In other words, the screen segments 156 are arranged transverse (and, in some cases, orthogonal) to the track 120 followed by the vehicle 132. A projector or projection assembly 117 may be provided to display video or still images upon the screen segments 156. Typically, the displayed images on segments 156 will be tied to the show provided on screen 109 and within room 110 and may even disguise the opening to the next room 160 (e.g., to increase a dark ride effect such as an illusion of danger of a crash, of travel through an environment such as a thick jungle, or the like).

The vehicle 132 generally includes a base or body 134 with wheels/casters 136 and is driven at a velocity, $V_{CAR}$, along the track 120 by a drive 124 such as a drive cable or chain moving at a velocity, $V_{CABLE}$, as shown at 125 and attached to the vehicle body 134 via linkage 126 extending up through slot or guide groove 122. Typically, these two velocities would be substantially the same and in many theme or show portions of a ride system 100 may be relatively small in magnitude (such as less than 10 feet per second and often less than about 5 feet per second), but vehicle velocity, $V_{CAR}$, is generally not a limiting feature of the invention with the vehicle and screen assembly 130 being adapted in some embodiments for much higher speeds (e.g., the screen 150 can be actuated at high speeds by the vehicle 132).

An important concept of the ride system 100 is that the vehicle 132 is used to actuate or move the screen 150 to allow the vehicle 132 to pass from the first room 110 to the second room 160. In the illustrated embodiment 100, this is achieved by providing the screen 150 with a number of screen segments 156 that may move independently from each other such as about a rotatable or hinged edge connected to the frame or support structure 152. The vehicle 132 includes a cover or roof 140 that is adapted to actuate or move the segments 156. In some embodiments, this may be achieved by providing rollers on one of the roof 140 and the segments 156 such that the segments 156 roll over the outer surfaces of the vehicle cover or roof 140 (such as a roller provided at or near the tip or side/edge of each segment 156 that rides on a track or rail 144 of the roof 140). The screen segments 156 may then return to their original positions using their own weight (e.g., gravity based return that may be useful for at least partially vertically hanging segments 156) and/or using a forced return or force-assisted return to a closed or original position such as may be achieved with springs or other resilient members provided on the mounting assembly and/or by use of counterweights on the mounting assembly, which may be useful for segments 156 that are horizontally mounted and cannot rely on gravity and their own weight to return to a closed position.

In one preferred embodiment, the vehicle and screen assembly 130 are adapted to make use of magnetic levitation or magnetic repulsion to provide a touch free or no contact ride-through screen experience. In this embodiment, the ride vehicle 132 is designed or modified to include a set of rails 144 that are arranged on the cover 140 to align with the sweep of the individual screen segments 156. Typically, there are at least as many rails 144 as there are segments 156 in the screen assembly 150 (or like numbers in most cases) and each rail has an outward facing, line array of permanent magnets. In each rail, the magnets all have the same magnetic pole (e.g., N or S) facing outward from an outer (or exposed "contact") surface of the rail 144. The screen 150 is segmented into triangular segments 156 in one embodiment to provide one useful structure and function for a screen 150 that may be closed together to separate room 110 from room 160, to receive a projected image from projector 117, and also to easily separate along its seams (or dividing/neighboring edges).

Each segment may be hinged or otherwise mounted on its outside edge (e.g., edge near the structure or frame 152), and, in some embodiments, its hinged geometry is centered and perpendicular to a corresponding or paired rail on the vehicle (e.g., a line extending from a tip of the triangular segment 156 from a proximate "contact" or exterior surface of the rail or array of magnets may be orthogonal to a base edge or side of the segment that is next to the frame 152 and may also bisect this edge or side to provide desired centering or alignment of the segment 156 with the rail 144). Each screen segment 156 may have on its tip a permanent magnet of the same pole as the magnets arrayed on a matching one of the rails 144 (e.g., a rail with N poles facing outward would be paired with a segment tip having a magnet with its N pole oriented toward the oncoming vehicle 132 such as with the magnetic field generally parallel to the direction of travel of the vehicle or the track 120). As the vehicle 132 moves into or proximate to a plane of the screen segments 156, the screen segments 156 are levitated away from the roof 140 by the mutually repelling magnetic forces.

The screen-actuating vehicle 132 passes through the screen 150 without contact as the segments are maintained by the magnetic repulsion at a distance (e.g., 1/32 to 1/2 inch or more) that will vary in magnitude based on the power of the magnets utilized in the rails 144 and tips of segments 156 and other design parameters such as weight of screens 156, resistance of hinge or other mounting assemblies, speed, $V_{CAR}$, of the vehicle 132, and the like. In some embodiments, the vehicle and screen assembly 130 is configured for the vehicle 132 to pass through in one direction and, in other embodiments, the vehicle 132 may actuate the screen 150 in both directions which may require a second magnet(s) to be provided on the tip of segments 156, to have the hinged attachment operate in both directions, and to have the rail be designed for mating with and levitating the segment 156 with the tip magnet in either direction (e.g., a symmetric arrangement or the like). Further, the roof 140 and the rails 144 are adapted to allow guests to enter and exit the vehicle 132 such as by having the roof 140 open or by having at least some of the rails articulate (e.g., rails 144 on one side may be pivoted about end mounts to allow passengers to enter and exit a vehicle 132).

Figure 2:
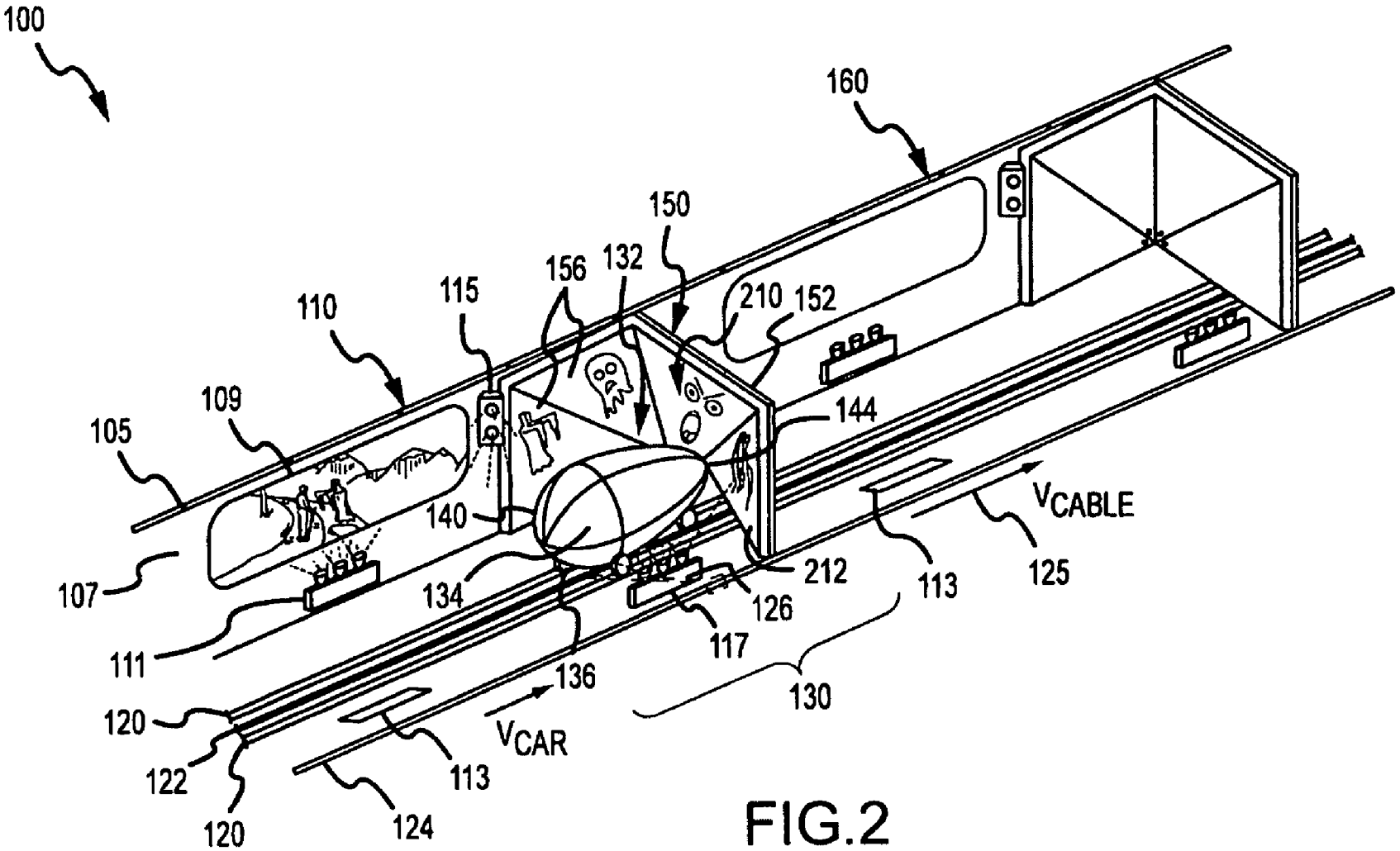
FIG. 2 illustrates the ride of FIG. 1 at a ride-through stage or mode of operation in which the vehicle is shown moving the segments of the screen out of its path as the vehicle moves along the track to a next portion of the ride (e.g., into a next room or portion of the track in which a new segment or scene of the show is presented)
Figure 3:
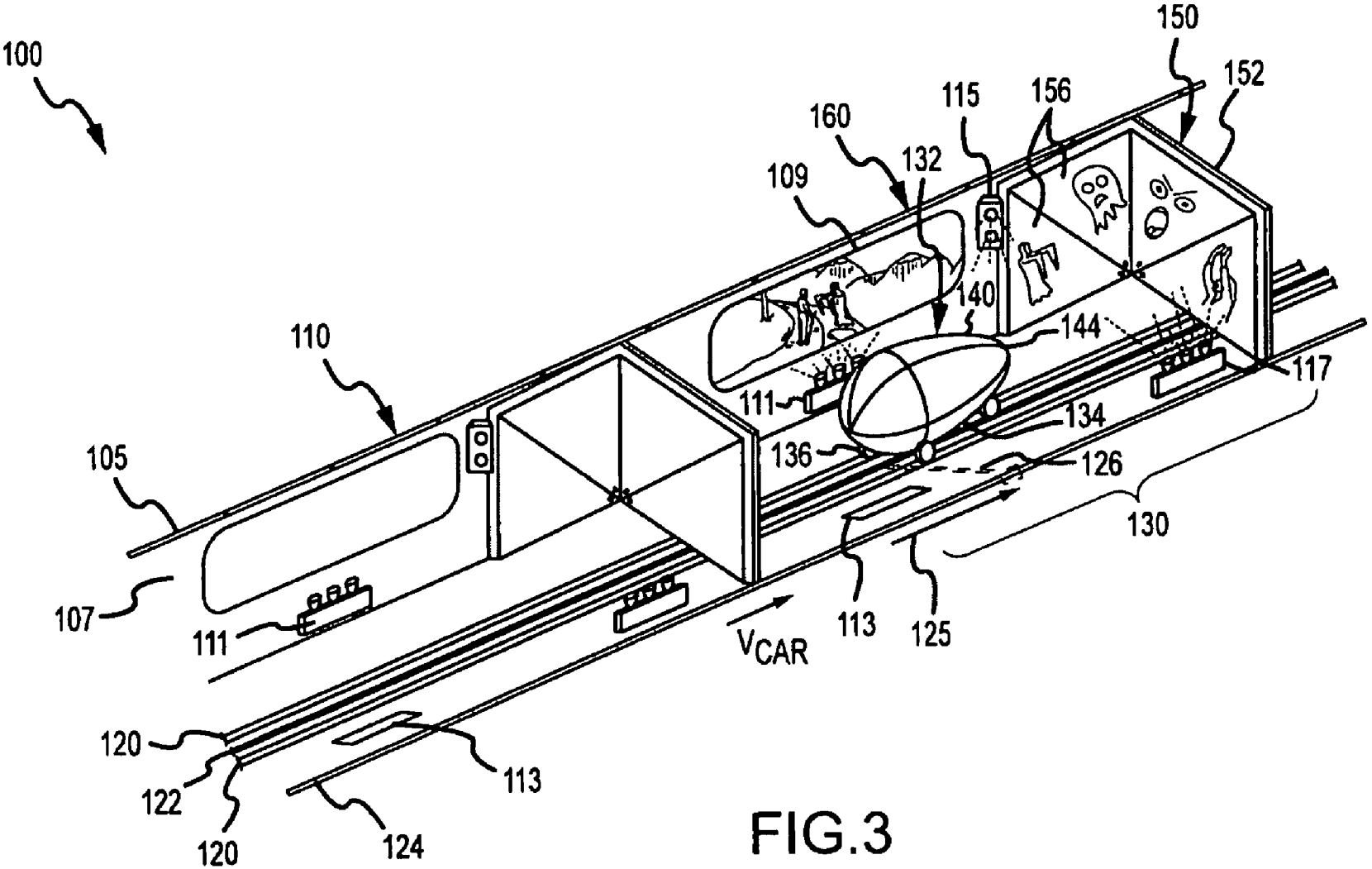
FIG. 3 illustrates the embodiment of FIGS. 1 and 2 with the vehicle fully within the second room with the next scene or show portion being presented and the first screen returned to its original or closed position.

FIGS. 1 to 3 illustrate the ride system 100 during operation to provide a themed ride or an attraction with a show provided with a ride-through screen. As shown in FIG. 1, the vehicle 132 is located in room 110 where its passengers experience a show (e.g., screen 109 and projector 111 and audio system 115) as it travels at a ride speed, $V_{CAR}$. The show may also include images (and associated audio) provided on screen segments 156 via projection or display assembly 117, with the screen segments 156 being transverse or, in some cases, in a plane that is orthogonal to the direction of travel of the vehicle 132. The screen segments 156 are formed of a material (such as a colored or white cloth/fabric, a white or colored seamless paper, textile backed (or supported) projection screen surfaces such as glass beaded, silver matte, or the like, an unsupported vinyl projection screen material such as Pearlescent™ or the like, or many other materials with or without a backing layer) that is useful for displaying images and also for blocking video and, in some cases, sound from traveling to or from neighboring or adjacent room 160.

In the shown embodiment of assembly 130, the screen 150 includes four relatively equally sized segments 156 (e.g., isosceles triangular shapes), and the vehicle 132 includes four arcuate or curved rails 144 extending across the exterior surface of the roof or cover 140 so as to be proximate to the tips of the segments 156 when the vehicle 132 passes through the screen 150. Of course, the screen 150 may include fewer segments such as one large screen but more typically two or three segments or more such as 5, 6, or more are included, and the vehicle 132 would be configured with at least a matching number of rails or series of magnets (e.g., the magnets may be provided on the roof 140 or vehicle without use of a rail in some embodiments such as by attaching the magnets directly to the roof outer surface in a pattern to provide desired alignment with the tips of segments 156 and any included magnets).

FIG. 2 illustrates the ride system 100 in a transition stage or mode in which the vehicle 132 is driving or riding through the screen 150 from one room 110 (or show scene) into a second room 160 (or show scene). As shown, the vehicle 132 has entered the plane of the screen segments 156, and, in some embodiments, the roof 140 or its exterior surface or rails 144 is used to contact and actuate or move the segments 156 such as about their hinge-mounted bases or edges near the frame 152. In magnetic levitation embodiments, though, the rails 144 include a series of like pole magnets that actuate the segments 156 by repelling a magnet(s) in the tips of these segments with mutually repulsive magnetic forces. The length and number of the magnets in the rails 144 (or otherwise provided on the vehicle 132) are such that the vehicle 132 may pass or ride through the screen 150 with no contact of the screens (or, in some embodiments, contact is allowed for a trailing edge of the vehicle such as after the portion of the vehicle including the passengers or their viewing windows or line of sight has passed through the screen segments 156). As shown, each of the segments 156 is separated along its side(s) from adjacent or neighboring ones of the segments 156 and is rotating about its base or mounted edge as shown with arrows 210, 212. The show may continue in its entirety or in part during this transition (e.g., the vehicle 132 may drive into a screen 150 that is active or being used to display images such as from projector 117 or a rear projector device or the like) or the show of room 110 may be phased out or turned off as the vehicle contacts or approaches the screen 150.

FIG. 3 illustrates the ride system 100 after the vehicle 132 has passed through the room-dividing screen assembly 150. As shown, the first show has been ended because there is no vehicle present, but it may be started when a next vehicle is sensed by sensor 113 and such a next vehicle may closely follow vehicle 132. The screen 150 is shown returned to a closed or original position with the screen segments 156 in a lowered position with their tips close and side edges close together to provide a relatively solid projection screen. Again, the returning to the closed position may be achieved with gravity because the segments 156 may be mounted with the closed position as the neutral or at rest position, e.g., when an outside force such as the repulsive forces between the tip and vehicle magnets is not present, the screen segments 156 tend to return to this closed position. In some cases, additional closing components are provided such as a spring-type hinge or a counterweight assembly to force the segments 156 to return to the closed position shown in FIGS. 1 and 3. The magnets provided in the tips of segments 156 may be arranged or mounted such that their magnetic forces act to attract the adjacent magnets and corresponding tips so as to use attracting magnetic forces to hold the tips in the closed position (e.g., until a next vehicle 132 passed through the screen 150). As shown in FIG. 3, a show scene or portion may be provided to the vehicle 132 in the second room 160 such as with additional video and audio projection/display devices and another screen assembly may be provided similar to that of screen 150 to separate the room 160 from a next room (not shown).

Figure 4:
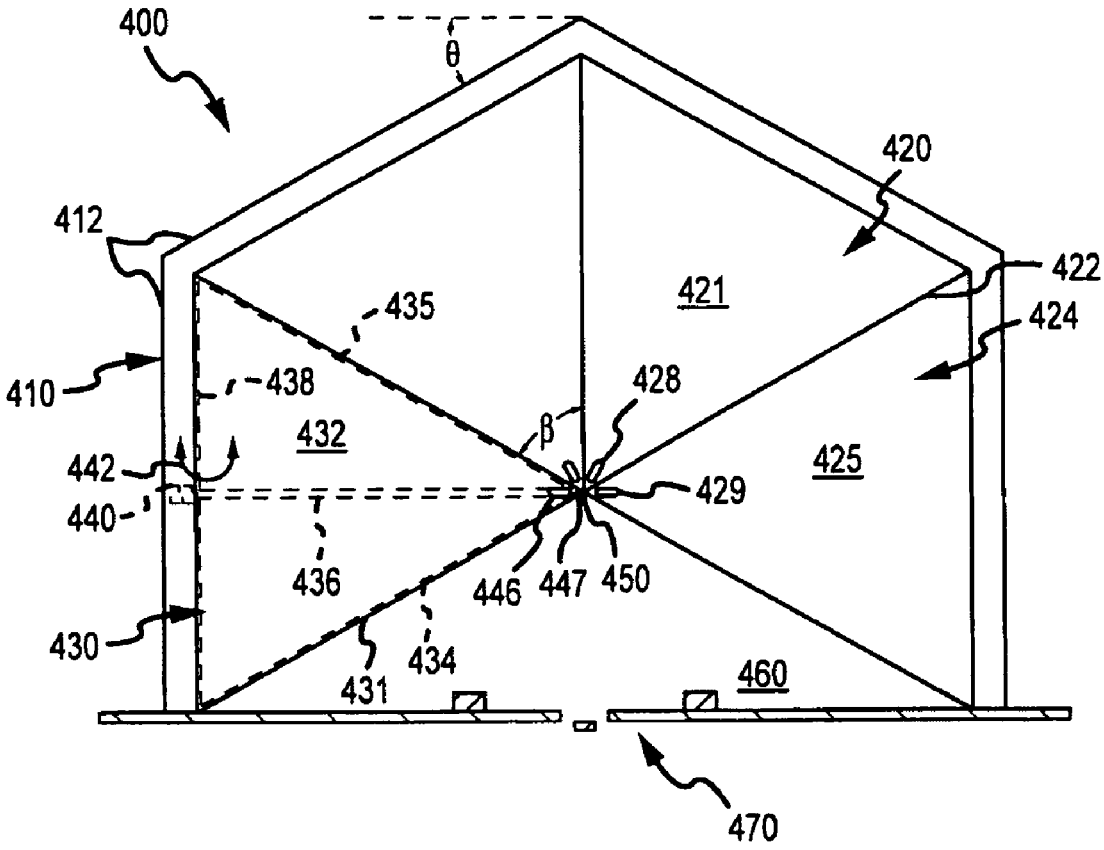
FIG. 4 is front (or vehicle) view of a ride-through screen assembly of an embodiment of the present invention using magnetic levitation to move screen segments away from a passing vehicle in a touch free manner.

FIGS. 4-9 illustrate a screen assembly 400 and a ride vehicle 600 that may be used together to provide a vehicle and screen assembly of an embodiment of the present invention that uses magnetic levitation to provide a no contact, ride through screen. FIG. 4 illustrates a front view (or vehicle side) of a ride-through screen assembly 400. As shown, the screen assembly 400 includes a frame 410 made up of a number of structural members 412, which may be free standing to encompass a vehicle track assembly 470 upon which a vehicle may ride and/or be attached to a ceiling and/or sidewalls of a ride tunnel or passageway (not shown in FIG. 4). The top members 412 may be symmetric about a center of the frame 410 and be provided at an angle, θ, to horizontal such as 15 to 60 degrees such as to descend at about 45 degrees from horizontal to meet vertical side members 412 of frame 410.

The screen assembly 400 includes four screen segments shown by adjacent representative segments 420, 424 that meet at seam 422 when the assembly 400 is in an at rest or closed position as shown. The four segments are shown to be of equal size and shape in this embodiment 400, although this is not required to practice the invention, and, more specifically, are shown to be triangular in shape (e.g., an isosceles triangle with a tip angle, β, such as up to about 75 degrees but more typically a smaller value in the range of 30 to 60 degrees is used). A magnetic element 428, 429 is provided at or near the extreme end of the tip of each element 420, 424 and assists in maintaining the segments in a closed or mating position 450 of the assembly 400. Typically, the magnetic elements 428, 429 are permanent magnets with similar poles directed toward an oncoming vehicle on track assembly 470. Each segment 420, 424 also includes a projection surface 421, 425 which may be a side of the body of segments 420, 424 that is adapted particularly for displaying an image that is projected upon the assembly 400. An optional open area or space 460 is provided at the bottom of the screen assembly 400 to facilitate the track 470 passing through the screen assembly 400, but, in other embodiments, segments may extend into space 460, e.g., with pivotable or hinged edges provided adjacent the tracks 470 and mounted to the floor such as one on either side of tracks or guide rails for the ride system.

Segment 430 is shown in more detail to better explain one useful configuration for the screen assembly 400. Segment 430 includes a body 431 that is configured as an isosceles triangle, and a projection surface 432 is provided on the body 431 and positioned to face a vehicle on track 470. The body 431 may be fabricated from a lightweight cloth or fabric with a surface texture and/or configuration adapted to achieve a desired visual effect, e.g., to suit the projected video from a display device and/or to suit the scene or show effect provided in the room containing the screen 400. Since a lightweight fabric may be used for body 431, side cables (or rigidity elements that may be formed of wire or the like) 434 and 435 may be provided on each side to allow the fabric of body 431 to be kept in the triangular shape and/or to allow the fabric to be stretched to a desired tightness (e.g., to make the surface 432 substantially planar and the edges sharp or well defined on sides near side cables 434, 435). The side cables 434, 435 may extend the length of the sides to the tip 447 where they may be joined or simply terminate. At the other end, the side cables 434, 435 may be linked to a base member 438 such as a rod, bar, or the like that extends along the base of the triangular body 431 and the fabric of the body 431 may be attached to this base member 438. To allow the body 431 to pivot or rotate about its base, the base member 438 may be attached to a hinge or pivotable mounting device 440, which is affixed to the frame member 412 (such as on the back side as shown in FIG. 5).

A magnet element 446 such as a permanent bar or disk magnet (e.g., a powerful rare earth magnet or the like) is provided at or proximate to the tip 447 and centrally positioned to provide alignment with the other magnets in tips of other segments and with a corresponding series of actuating or levitating magnets on a vehicle. The magnet 446 may be positioned with a pole face in a plane that is perpendicular to a plane containing the track 470 as it passes through screen 400. In other embodiments, the magnet 446 is provided at an angle such as 0 to 45 degrees from such an orthogonal plane so as to better direct a repelling magnetic field toward magnets on an approaching vehicle's cover or roof. To provide further rigidity and structure, a support member or arm 436 is provided that extends out from the base member to the tip 447 (e.g., a 0.25 to 1 inch or larger metal or plastic rod or bar that extends outward from a midpoint of base member 438 to bisect the angle, β, at the tip 447).

Figure 5:
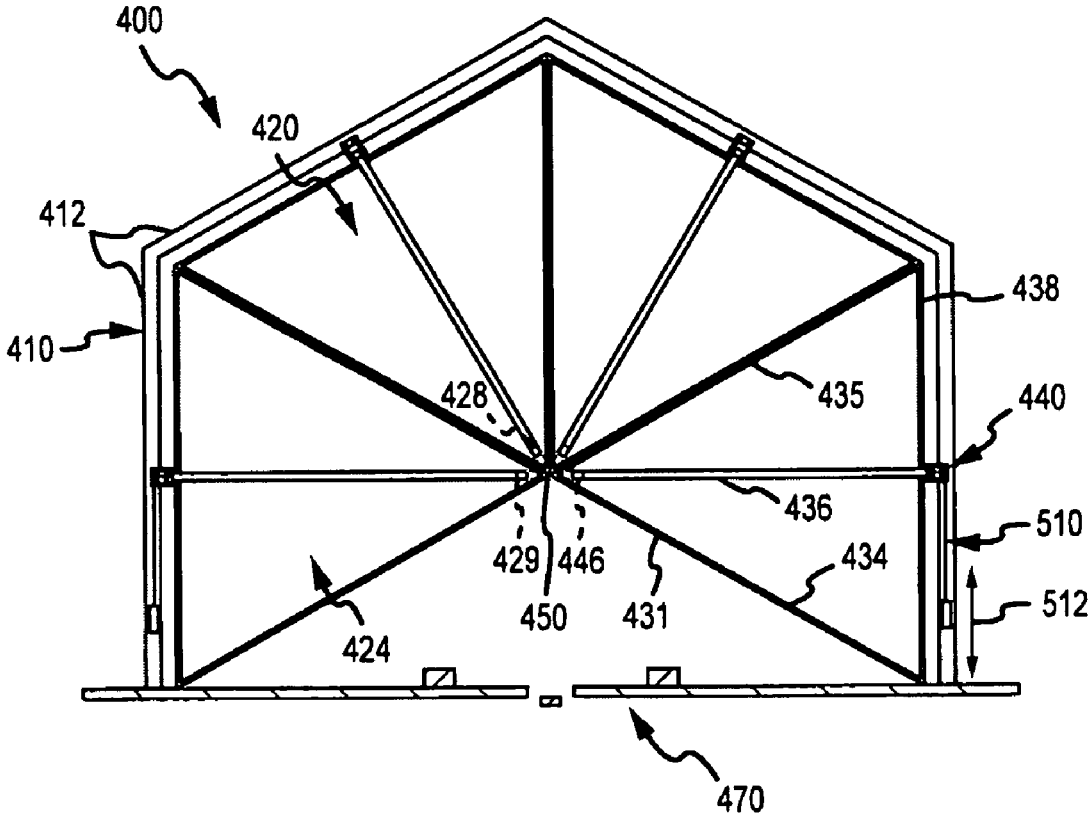
FIG. 5 is a back view of a ride-through screen assembly of an embodiment of the present invention.

FIG. 5 illustrates a back or hidden side of the screen assembly 400 that shows hinged or pivotal mounting such as with hinge 440 for each of the screen segments with attachment to their base members such as member 438 to hinge 440. Also shown is a counterweight assembly 510 that may be attached to the base member 438 to resist opening of the segment 430 but also assist in returning the segment 430 to the closed or original position as shown with arrows 512 near the counterweights. Instead of counterweights, the hinge 440 may include a spring or resilient member or such as a return element that may be attached to the body 431 (e.g., similar to a standard screen door closing assembly). Such motion-assist assemblies are particularly useful in side or horizontally mounted segments such as segment 430 that typically will not return to the closed position after being opened without such assistance (e.g., gravity alone typically cannot be used to close or return these segments to their original positions) after a vehicle passes through. Motorized or mechanisms that can be actuated such as based on a vehicle being passing a point on track 470 beyond the screen assembly 400 may be used on the side or horizontal segments, but such inclusion may complicate the assembly 400, which is shown as a "passive" device, and add to fabrication and maintenance costs.

Figure 6:
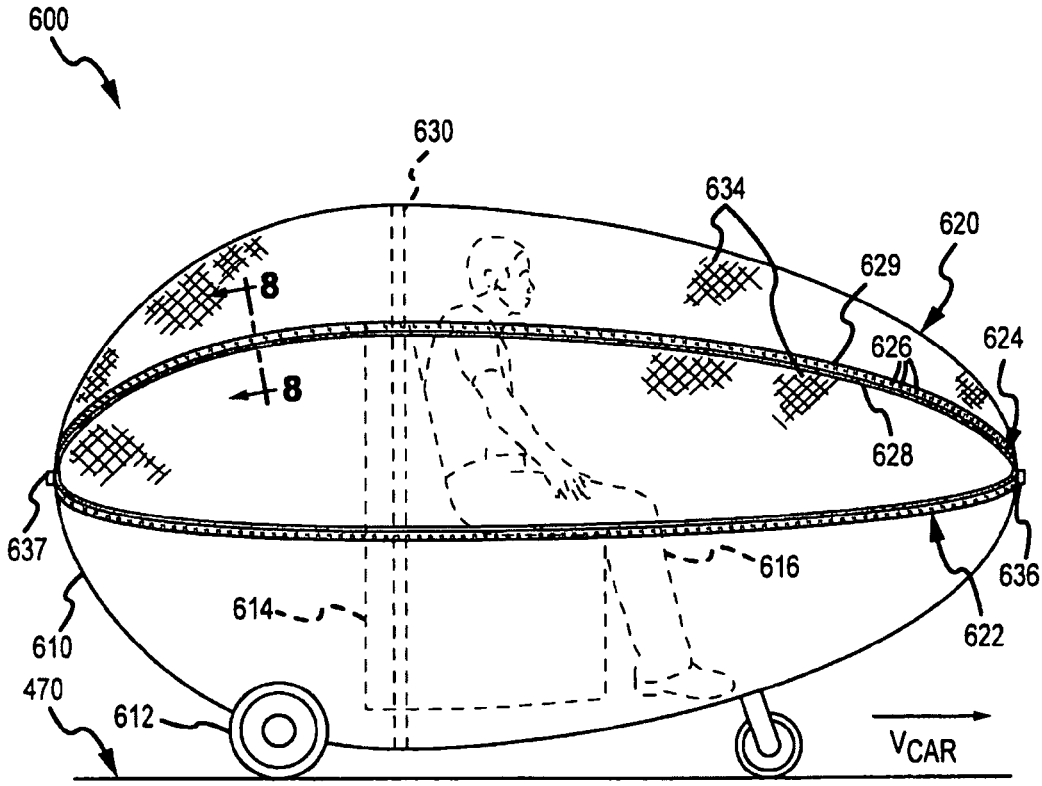
FIG. 6 illustrates a side view of vehicle for use with the screen assembly of FIG. 5 including a cover configured for screen actuation with curved or arcuate rails each providing a series of magnets with same or like poles directed outward for magnetically levitating corresponding or mating screen segments away from the vehicle's outer surfaces.
Figure 7:
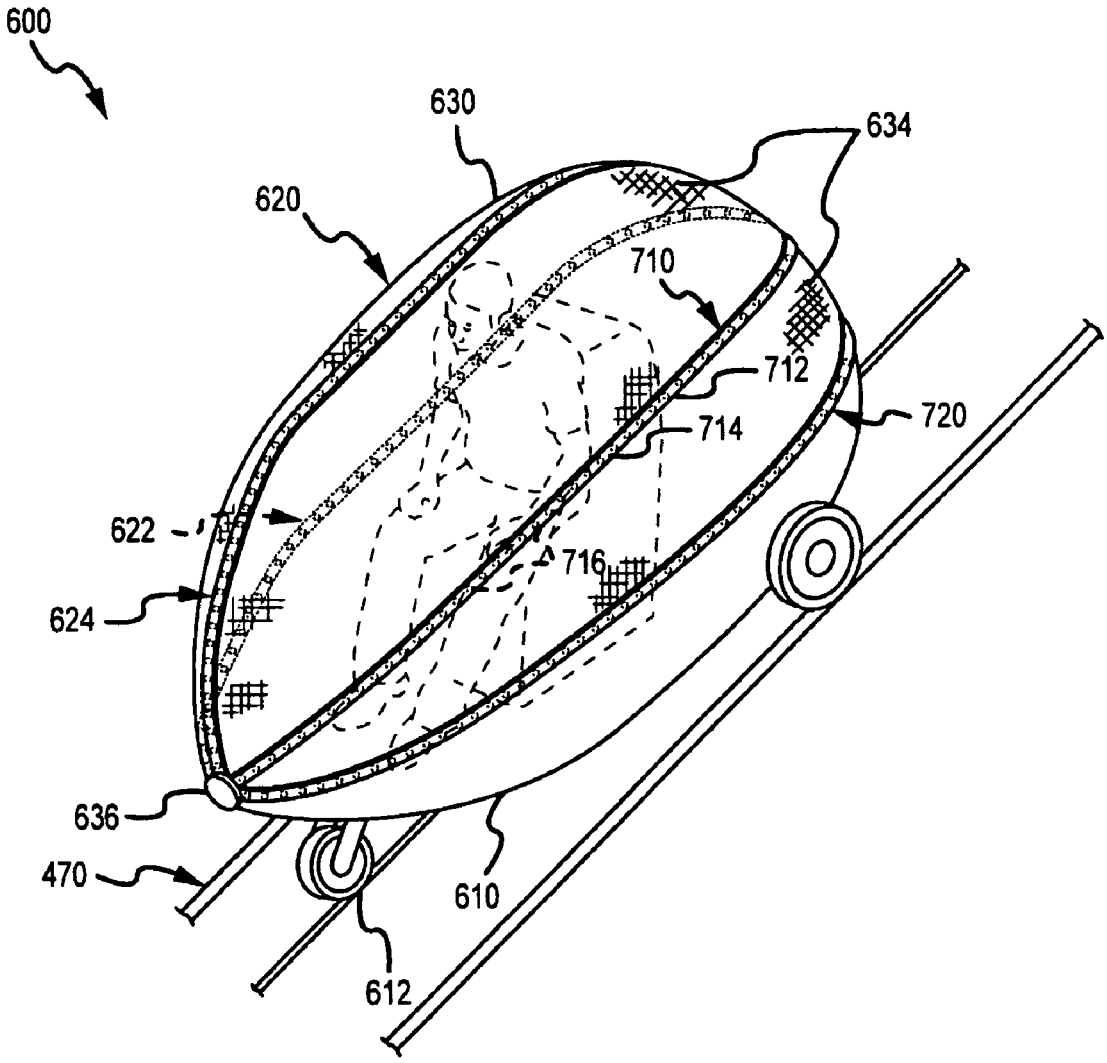
FIG. 7 is a perspective end view of the vehicle of FIG. 6 showing all four levitation rails or rail assemblies of the vehicle cover (or retractable top)

FIG. 6 illustrates a side view of a screen-actuating vehicle 600 of an embodiment of the invention that uses magnetic levitation to actuate the screen assembly 400 of FIGS. 4 and 5. FIG. 7 shows the vehicle 600 from a front perspective view as it may appear as it approaches the screen 400 to ride through it. As shown, the vehicle 600 includes a base or body 610 with one or more seats 614 for seating for passenger(s) 616. The body 610 includes a set of wheels, casters, or other components 612 that allow the vehicle 600 to be driven at a particular velocity, $V_{CAR}$, along a track 470 that passes through screen assembly 400. The vehicle 600 further includes a frame 630 extending upward from the body 610, such as in an arc or curve to provide a structural support and/or to guide travel of a roof or retractable top assembly 620.

The roof assembly 620 is attached to the body 610 at each end as shown by mounting elements 636, 637. The frame 630 may provide supports at one or more points along the expanse or length of the top 620. Significantly, the top 620 includes a set or number of actuation or levitation rail assemblies 622, 624, 710, 720 that extend along the length of and in spaced-apart fashion across the surface of the top 620 to function to actuate and/or move corresponding screen segments of screen 400 out of the path of the vehicle 600. Each of these assemblies 622, 624, 710, 720 typically is configured similarly.

With reference, for example, to rail assembly 624, the assembly 624 includes an elongate, arcuate or curved rail 628 that is pivotably mounted at its ends to mounting elements or pins 636, 637. The rail 628 is used to support and align a series of magnets 626, e.g., a plurality of permanent disk or bar magnets with like poles facing outward from the rail 628. A cover strip 629 may optionally be provided over the magnets 626 to retain them in place in the rail 628 and/or to provide a protective and/or disguising cover (e.g., to heighten the illusion of how the screen segments are actuated or moved away from the approaching vehicle 600).

Figure 8:
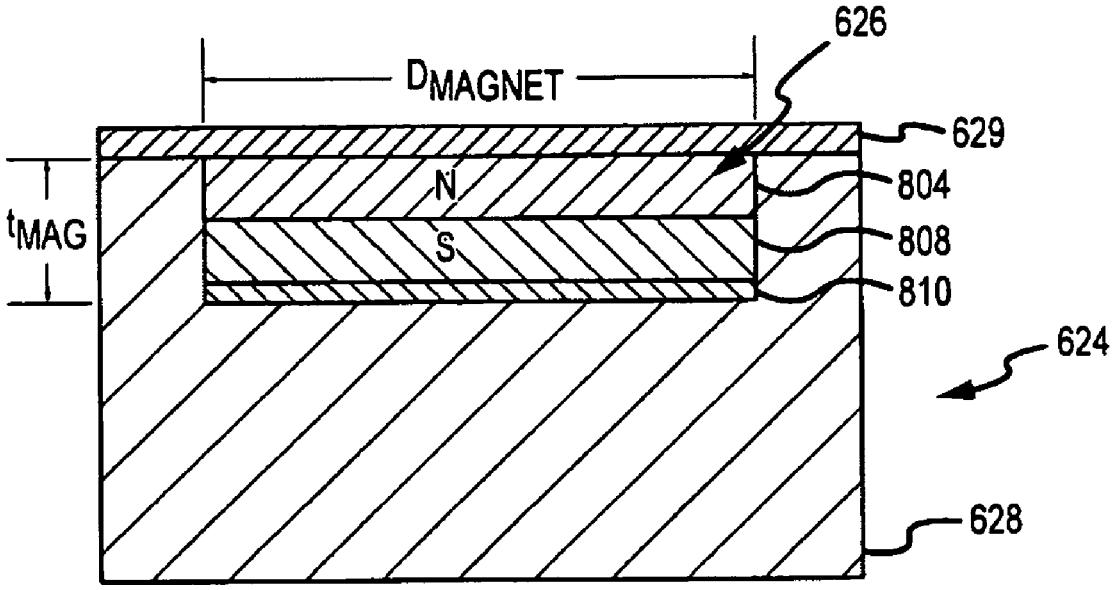
FIG. 8 is a sectional view of a levitation rail assembly of the vehicle of FIGS. 6 and 7 taken at line 8-8.

FIG. 8 illustrates a sectional view of the rail assembly 624. In this embodiment, the rail 628 includes a recessed surface or groove in which the magnets 626 are received with an orientation that directs the N pole 804 of the magnets 626 facing outward from the rail 628 and with the S pole 808 facing inward (e.g., the series of magnets 626 in a rail assembly 624 have the same pole exposed for use in levitation or actuation of a corresponding screen segment). Adhesive 810 may be used to attach the magnets 626 to the rail 628 or in other cases the magnets 626 may be interference fit into the rails 628 or the cover 629 may be used to hold the magnets 626 in place in the assembly 624. Other restraining techniques may be used, with such restraint typically being desirable to allow the magnets 626 to be positioned relatively near to each other without magnetic forces "popping" the magnets out from the rail 628. For example, the magnets 626 may be disk or circular magnets with a particular diameter, $D_{MAGNET}$ (such as 0.25 to 1 inch or larger magnets) and a particular thickness, $t_{MAG}$ (such as up to 3/16 inches to ½ inch or more thick), and to maintain a relatively uniform levitation magnetic force along the length of the rail 628 it may be desired to abut or nearly abut these magnets 626. For example, when circular magnets are used the repulsive forces between adjacent magnets and their other characteristics may require a small space between neighboring or adjacent magnets 626 such as up to about 0.125 inches or more (with closer typically preferred). In other embodiments, the magnets 626 are block or rectangular magnets, and these may be placed in abutting contact in some cases along the rail 628. The cover strip 629 is typically formed of a non-magnetic material and is relatively thin to place the surface of the magnet 626 near the exterior "contact" surface of the rail assembly 624.

Referring again to FIGS. 6 and 7, the rail assemblies 622, 710, and 720 typically would be configured similarly to rail assembly 624, and FIG. 7 shows that assembly 710 includes an elongate, arcuate rail 712, with a groove including a plurality of magnets 716 extending along the length of the rail 712, and a cover plate or strip 714 over these magnets 716. In the illustrated embodiment, the top assembly 620 further includes a screen or sheet 634 extending over or under the rail assemblies or between such assemblies, and it may function to enclose/define the interior of the vehicle 600 and may be formed of substantially see-through or a material/fabric that allows passengers 616 to view a show displayed outside of the vehicle 600. Typically, the roof screen 634 is fabricated of a relatively flexible material that draws tight when the rail assemblies 622, 624, 710, 720 are in the closed position shown in FIGS. 6 and 7.

Figure 9:
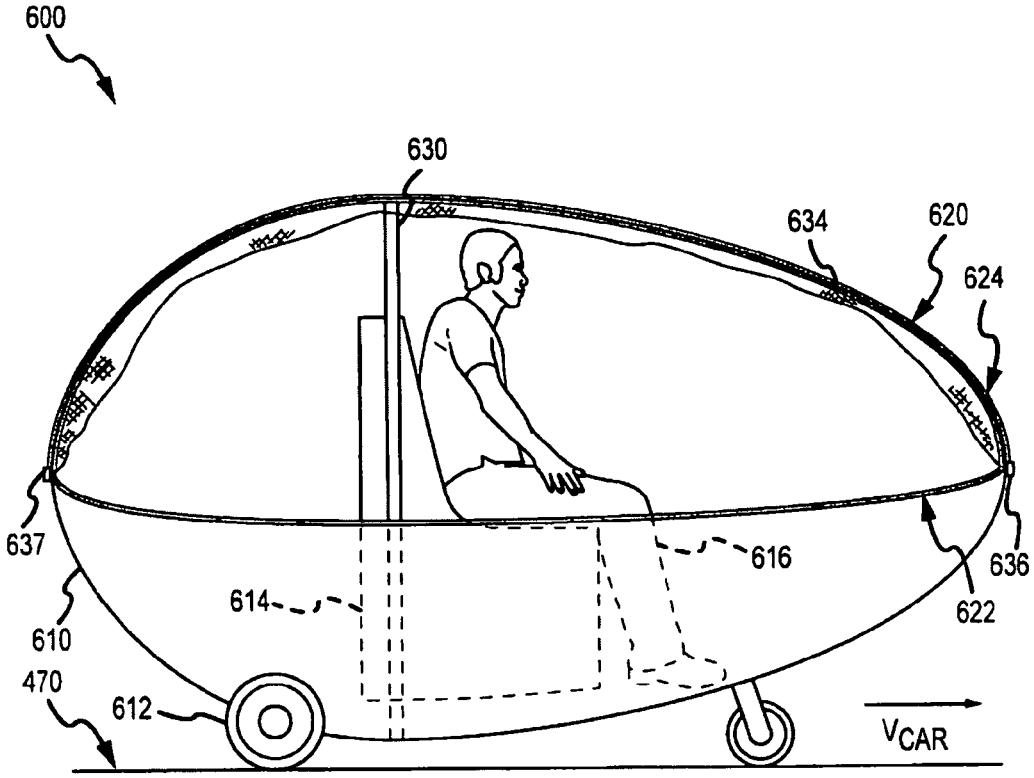
FIG. 9 illustrates a screen actuation vehicle as provided in FIG. 6 with the cover or roof opened for loading (e.g., with at least some of the levitation rail assemblies retracted or moved to allow passenger entry into the vehicle)

To allow passengers 614 to enter and exit the vehicle, one, two, or more of the rail assemblies (and the adjoining roof screen 634) typically are able to be articulated or moved. For example, as shown in FIG. 9, the vehicle 600 is shown with the top assembly 620 in the open position or mode of operation. To place the vehicle 600 into this open position, the rail assemblies 622, 624 are pivoted about end mounts 636, 637 to move along the curved inner support 630, and the roof screen 634, which may be a mesh material such as a dark screen material or net with small holes or gaps or the like, is compressed or accordioned together between the rails.

After the passenger(s) 614 are positioned into the vehicle 600, the vehicle 600 is moved along the track 470 such as through a show portion or room where a video and audio show is presented, which may include displayed imagery on screen segments or display surfaces of screen assembly 400. The vehicle 600 then transverses the screen plane containing the screen segments 420, 424, 430 until the rail assemblies 622, 624, 710, 720 initially are placed in proximity to tips of the screen segments and the magnets 428, 429, 446 contained therein. Note, there are at least as many rail assemblies as screen segments and an actuating rail assembly is aligned with or paired to each screen segment (e.g., with the rail assembly placed in proximity with the magnet of the screen segment). The magnets in each rail assembly generate a magnetic field with a like polarity as that found in the aligned, paired screen segment (e.g., both N poles or both S poles), and this creates a repelling or levitating magnetic force between the nearest one, two, or more magnets in the rail and the tip magnet(s). As a result, the tip and the corresponding screen segment are pushed away from the proximal magnet(s) of the rail, which are approaching the screen assembly 400 at the velocity, $V_{CAR}$, of the vehicle 600.

The rails are shaped such that as the vehicle travels through the screen each magnet in the series or set of levitation magnets in the rail is placed adjacent the tip magnet and repels the tip. The shape may be, as shown, a generally arcuate or elliptical shape or another shape/geometry to practice the invention with the shape depending upon the path traveled by the tip (or magnet in the tip) of the screen segment as it is rotated out of the path of the passing vehicle 600 (i.e., the invention is not limited to a particular rail shape as long as levitation is maintained as desired to provide touch free or, in some cases, a limited amount of contact such as after the passenger's or view portion of the vehicle 600 has passed the screen plane).

Figure 10:
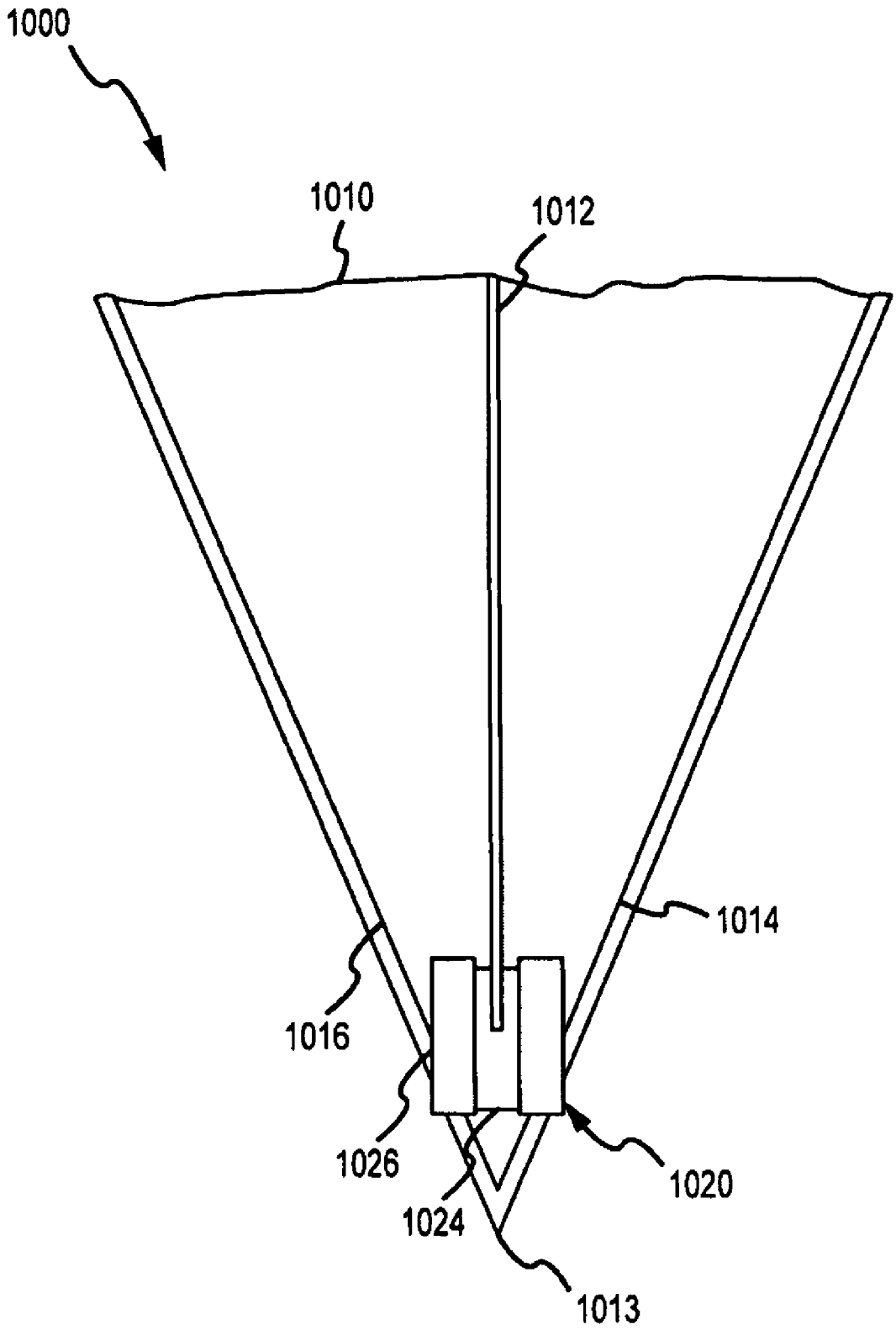
FIG. 10 illustrates another embodiment of a ride-through screen segment including a roller assembly rather than a magnet near its contact point or tip to allow vehicle actuation.

Some embodiments of the invention provide a vehicle and screen assembly in which the screen is actuated or moved by the vehicle, but the screen is actuated by physically contacting the exterior surface of the vehicle. For example, the vehicle may take a form similar to that shown in FIGS. 1-9 but without the magnets and, in some cases, without the rails shown (such as when the roof has a rigid exterior rather than flexible screen or sheet on the retractable portion). FIG. 10 illustrates a screen segment 1000 that may be used when magnetic levitation is not used and contact is allowed for actuation by the vehicle. The screen segment 100 includes a projection screen or body 1010 that is triangular in shape. A pair of edge rigidity elements 1014, 1016 are provided along with a central structural member 1012 (e.g., a bar, rod, or the like) that may be attached at the other end to a hinged base member (not shown).

At or near the tip 1013 of the segment 1000, a roller assembly 1020 is provided that may be connected with a central base or hub member 1014 to the structural member 1012. A pair of wheels, rollers, or casters 1026 may be pivotably attached (such as an axle(s)) to the hub member 1024. During operation, the rollers 1026 contact an exterior surface of a passing vehicle, such as the rail assemblies or their cover strips/sheets shown for vehicle 600. The roller 1026 typically stays in contact with the roof surface or rail as the screen segment 1000 (and others like it provided in a screen assembly) is actuated or pushed apart and around the passing vehicle. As with the screen assembly 400, the screen segment 1000 would then be returned to its original or closed position such as by gravitational forces and/or with assistance by a spring hinge, counterweight, or other mechanism.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. One aspect of the above description is that the vehicle itself is used to actuate a screen, which may be used as a projection screen or surface for a video show portion of a themed ride. The actuation may be mechanical or by touch/contact while many preferred embodiments utilize permanent magnets such as rare earth magnets (round or bar) to magnetically repel or levitate the screen segments. To this end, a series of magnets of a same pole are arranged (such as in a rail, on the exterior surface of the roof, in recessed surfaces provided in a molded, retractable roof, or the like) to match a travel or swing path of a magnet(s) located in the tip or other portion of a screen segment as the screen segment rotates or pivots from the travel path of the vehicle. In some illustrated embodiments, the shape or configuration of the magnets may be an arc or a portion of an arc such as when the vehicle is more spherical. In other cases, the shape is more elliptical while in other cases the configuration or shape of the series of magnets on the vehicle may be somewhat irregular (e.g., a combination of linear and curved sections). The number of magnets provided on the tip of the segment may vary to practice the invention, and some embodiments use two or more magnets arranged in a line or linearly that are utilized to provide a levitating (or repulsive) force to maintain the screen segment spaced apart (e.g., up to 0.5 or more inches) from the exterior surfaces of the vehicle.

In some cases, the alignment of the magnets (or their centers) is required to be relatively close or fine with the travel or swing path of the magnet in the segment tip or edge. Such close alignment is required because of the behavior of magnets and a desire to align or orient the relative magnetic fields of the vehicle actuation magnets and the actuated (or repelled) magnets in the screen segments. In other words, the magnetic fields of the like pole magnets may have to be nearly directly opposite to provide a mutually repulsive force rather than an undesirable attraction force (e.g., improper alignment may cause the segment to be attracted to contact or be attached to the vehicle roof). In some embodiments, the alignment along the length of the series of magnets or the rail containing the magnets in vehicles using rails is in the range of plus or minus 0.25 inches, but, of course, the alignment obtained or used will vary with the geometry and power of the magnets chosen for the vehicle and screen assembly.

The illustrated embodiments show screen assemblies that are used in a single direction. However, in some embodiments, the ride system may be designed such that the vehicle may travel in both directions on a track. In such embodiments, the vehicle may be configured to be symmetric with passengers facing both directions, and the series of actuating magnets or an actuation rail/track on the roof or exterior surface of the vehicle typically would be symmetric (e.g., with a similar shape on a front half and a back half of the vehicle body). In other cases, the vehicle may turn around at some point of the track and return along a same length of the track and pass through some rooms in both directions. In either of these cases, the screen assembly may be configured such that the screen segments may open in either direction based on a two directional hinge or pivotable mounting at their base or another edge/side. Further, one or more additional magnets (or other actuation devices) may be provided on the "back" side of the screen segments near their tips or edges (e.g., a magnet with a particular pole (i.e., a pole that is the same as that exposed or facing outward on the vehicle)) is provided on both sides of the screen segment. In this way, the vehicle may actuate the screen when traveling in either direction. In these embodiments, the screen segments may also be designed as projection surfaces on both sides.

Note, also, the screen segments are shown to contain one or more magnets at or near the tip of their triangular body or edge of their non-triangular door or panel shape. In some configurations of the vehicles and their series of levitation magnets, the segment or door magnets may be provided in other locations with a key aspect being that the (or one of the) first surfaces of the segment that is positioned proximate to the approaching vehicle contains a magnet (or a mechanical mechanism) used for levitating (or moving) the screen away from or around the vehicle as it passes through or near the plane containing the screen segments.

Note, the above description uses the term "screen" to generally mean a scenic element or object that is in the pathway of the vehicle (e.g., screening the path of a vehicle and/or view of riders of such vehicles). For example, FIGS. 1-10 discuss a screen or scenic element that has segments that are triangular in shape, but the invention is not limited to such an arrangement for the "screen." Also, these figures show an oblong or elliptically shaped vehicle(s) that is suited for such a segmented screen. In other embodiments, many other screen, door, or scenic elements/objects may be utilized to practice the invention such as a screen that is projected upon that is moved as a single unit or in segments as described, a mural or piece(s) of artwork, a "brick" or other structural appearing show element (e.g., appears as if the vehicle will crash into a solid wall that moves as a single unit or that is segmented as described as the vehicle "crashes" through it), or even a statue or an animatronic figure that is in the path of the vehicle. Each of these screens or scenic elements is actuated by the vehicle so as to be moved from the vehicle pathway in a touchless or contact manner.

Figure 11:
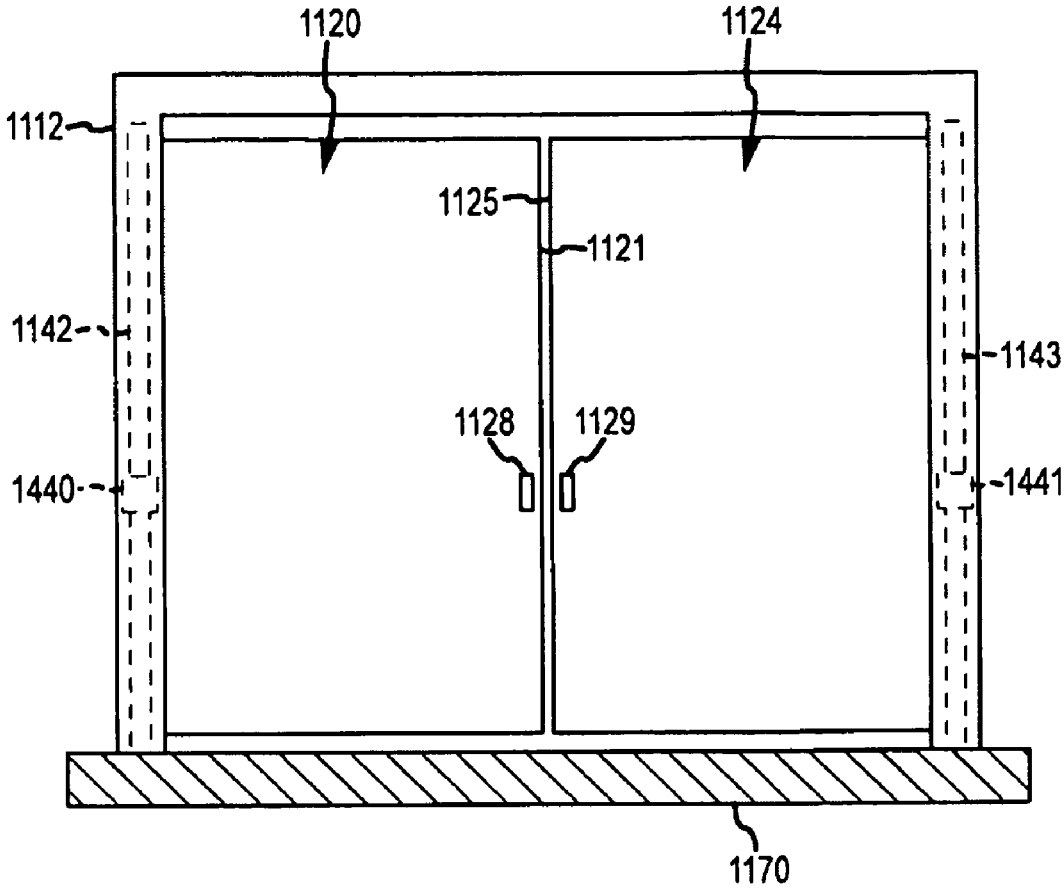
FIGS. 11 and 12 illustrate a screen/door and vehicle pairing or assembly of an embodiment of the invention.
Figure 12:
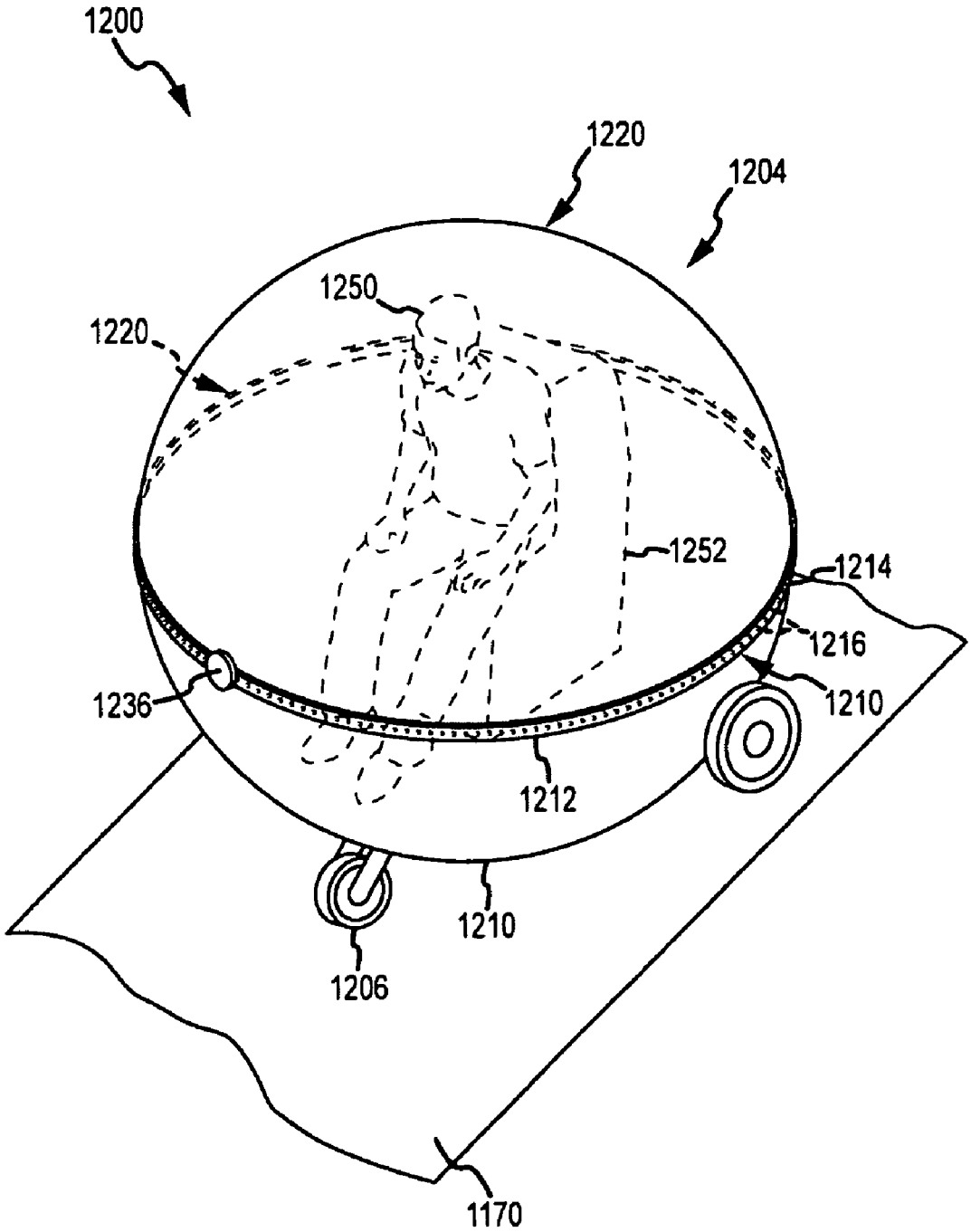

For example, FIGS. 11 and 12 illustrate a screen/door and vehicle pairing or assembly that may be used to practice the vehicle actuation functionality described herein. As shown in FIG. 11, the scenic element is a show door arrangement with a pair of side-by-side doors 1120, 1124 that are supported by a frame 1112. The doors 1120, 1124 appear as more conventional rectangular doors and are hung or supported on end elements or sides 1142, 1143 and allowed to pivot about these ends/edges 1142, 1143 on hinges or pivot members 1440, 1441. In the closed position shown, inner edges or sides 1121, 1125 of the doors 1120, 1124 are contacting or nearly in contact with each other to separate one show room or portion from another. Each door 1120, 1124 includes one or more magnetic elements 1128, 1129 (which may be replaced with rollers in some embodiments as discussed with reference to FIG. 10). As a magnetic with like pole (e.g., on a moving vehicle shown in FIG. 12) approaches the doors 1120, 1124, the magnetic elements 1128, 1229 cause the doors 1120, 1124 to pivot about hinges 1140, 1141 out of the path of the object or vehicle supporting the like pole magnets. Counter weight devices or other components may be provided to cause the doors 1120, 1124 to return to the closed position shown in FIG. 11 after being actuated or moved to an open position.

The doors 1120, 1124 (or screen or scenic element) may be supported on frame 1112 over a track as discussed for other embodiments of the invention. Alternatively, as shown, the doors 1120, 1124 are supported over a platform or floor 1170 that has no tracks. In this embodiment, the vehicle track is removed and the door or screen assembly of FIG. 11 is intended for use with a trackless vehicle. In amusement and theme parks, rides and rides with show elements are being created with vehicles that have travel over a trackless floor and the vehicles position is typically tracked and may be controlled to travel along a predefined path (or portions are defined). Such vehicles may be considered free ranging vehicles with their travel on a path typically monitored/sensed to allow the ride controls to know the location of all the vehicles and, in some cases, the travel is controlled closely but without or with minimal use of conventional tracks. The scenic element including the doors 1120, 1124 would be placed in the "path" of the free ranging vehicle such and the vehicle acts to actuate the doors 1120, 1124 when it passes through the plane and/or sweep of these scenic elements.

FIG. 12 illustrates a ride vehicle 1200 that may be used with the scenic element shown in FIG. 11 to actuate the doors 1120, 1124. As shown, the scenic element-actuating vehicle 1200 includes a base or body 1210 with one or more seats 1252 for seating passenger(s) 1250. The body 1210 includes a set of wheels, casters, or other components (such as an electric motor or the like) 1206 that allow the vehicle 1200 to be driven within a ride (such as a free ranging ride by components not shown) at a particular velocity along a path on the platform 1170. Specifically, this path includes the screen or scenic element shown in FIG. 11 with the side-by-side doors 1120, 1124, and the vehicle 1200 is adapted to actuate the doors 1120, 1124.

To this end, the vehicle 1200 includes a roof assembly 1204 with covers or panels (e.g., fabric or transparent/translucent materials) 1220. The roof assembly 1204 is attached at ends via mounting elements 1236. The top 1204 includes a set or at least a pair of actuation or levitation rail assemblies 1210, 1220 that extend along the length of or perimeter of the vehicle body 1210. The body 1210 differs from others shown in that it is generally spherical in shape, and the rail assemblies 1210, 1220 again include a rail 1212 housing a plurality or array of magnetic elements 1216 that are covered by a protective cover or shield 1214. The rail assemblies 1212, 1220 are positioned approximately at the midpoint of the spherical body 1210 with their location chosen to provide alignment with the magnetic elements 1128, 1129 on doors 1120, 1124 such that the vehicle 1200 functions to actuate or move the doors 1120, 1124 when the vehicle 1200 passes in proximity with the doors or in their plane.

Figure 13:
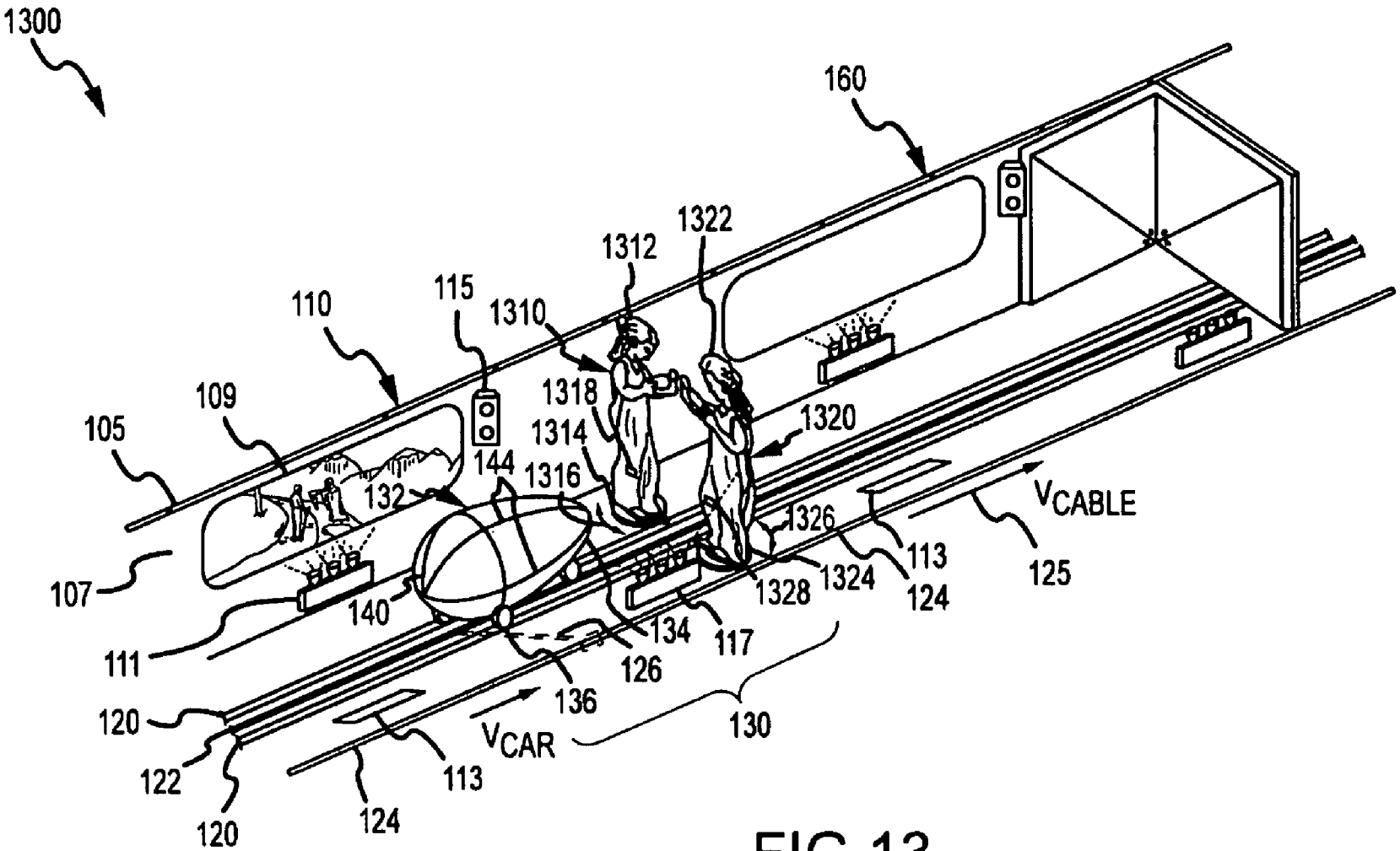
FIG. 13 illustrates another embodiment of a ride system with a screen assembly replaced with or including show or scenic elements that move out of the way of an approaching vehicle.

In some embodiments, the scenic elements will be objects other than more traditional appearing doors that are placed in the path of a scenic element-actuating vehicle, and during operation, these objects are actuated or moved out of the way in response to the vehicle coming in proximity and/or contact with such objects. For example, FIG. 13 shows a ride system 1300 similar to that shown in FIG. 1 but with a first screen assembly 150 replaced with differing "screens" or show/scenic elements. As shown, a first and second scenic element 1310, 1320 is placed over the track 120 or in the path of the vehicle 132. The scenic elements 1310, 1320 may be rigid or statue-type show characters or they may be animatronic characters operable to move and/or otherwise respond to the approaching vehicle 132. The elements 1310, 1320 have bodies 1312, 1322 mounted or supported upon pedestals 1314, 1324, and these pedestals 1314, 1324 are pivotally supported over the tracks 120 such that the elements may be actuated or forced out of the path of the vehicle 132. To this end, the scenic elements 1310, 1320 each includes a magnetic element 1318, 1328 on their bodies 1312, 1322 that are positioned to be aligned with one or more of the actuation or levitation rails 144 on the vehicle 132. In this manner, the elements 1310, 1320 are actuated or caused by magnetic forces to pivot out of the path of the moving vehicle 132 as described above for screen elements 156 with regard to FIG. 1.

The illustrated embodiments of ride systems such as system 100 of FIG. 1 emphasize use of the vehicle to actuate a screen or scenic element 150 that is positioned to be transverse or even orthogonal to a plane containing the track 120. However, the concepts taught for actuating the screen assembly 150 may also be applied effectively to scenic elements in differing planes or spatial relation to the moving vehicle 132. For example, it may be desirable to cover the track 120 of the vehicle such that passengers of the vehicle 132 cannot see the track or rails 120 such as giving the appearance of a vehicle in water or other surface that may be represented by the track covering or by images projected on such track covering. To this end, a plurality of track covering segments (or screen segments/scenic elements) may be arranged to cover the track 120 and extend in a plane that is parallel to the plane of the track 120 or at least transverse to the plane of the screen 150. Each of these track covering segments or scenic elements would be pivotally mounted or supported and would include a magnetic element(s). A plurality of magnetic elements would be positioned on a lower surface of the body or base 134 (again, with like poles as those of the track covering segments or scenic elements being exposed or facing outward) such as in levitation or actuation rails or the like. Then, when the vehicle 132 passes in proximity of the track covering segments these segments are actuated or moved out of the way in a contactless or touchless manner by magnetic forces (or rollers may be used as discussed above such as with reference to FIG. 10).

I claim:

1. An assembly for use with a vehicle track of a ride system in a theme or amusement park to provide a ride-through screen experience, comprising:

a vehicle for carrying at least one passenger with a base adapted for riding upon the vehicle track and with a top assembly provided on the base, wherein the top assembly comprises a first and a second set of magnetic elements proximate an exterior surface of the top assembly with the magnetic elements in each of the sets having a same pole oriented outward from the exterior surface; and a screen assembly comprising a first and a second screen segment pivotably mounted adjacent to each other and transverse to the vehicle track in a closed position, wherein the first and second screen segments each comprises a magnetic element with an exposed pole matching the same pole of the corresponding one of the first and second sets of the magnetic elements of the vehicle, whereby the first and second screen segments are magnetically levitated to an open position and away from the top assembly when the vehicle passes through the screen assembly without contacting the vehicle.

2. The assembly of claim 1, wherein the magnetic elements are permanent magnets and wherein the first and second series comprise a plurality of the permanent magnets arranged along a length of a levitation rail provided in the top assembly.

3. The assembly of claim 2, wherein the first and second screen segments comprise a planar body with a triangular shape and the magnetic elements of the screen segments are provided in a tip distal to a base side of the body and wherein the levitation rail has a curved geometry selected based on a swing path followed by a corresponding one of the screen segment magnetic elements as the screen segment is rotated about the base side of the body.

4. The assembly of claim 3, wherein the body comprises a projection surface for displaying a video image projected from a projector.

5. The assembly of claim 3, wherein the screen assembly further comprises third and fourth planar screen segments mounted adjacent to one of the first and second screen segments and each comprising a triangular body with a magnet element provided in a tip and wherein the top assembly further comprises third and fourth sets of magnetic elements in additional ones of the levitation rails, each of the levitation rails being arranged on the top assembly to be aligned with the magnetic element in one of the screen segments.

6. The assembly of claim 5, wherein at least one of the screen segments is pivotably mounted with a return mechanism configured to apply a force to the body of the at least one of the screen segments to return to an original position within the plane transverse to the vehicle track.

7. The assembly of claim 3, wherein the triangular shape is an isosceles triangle.

8. The assembly of claim 3, wherein the top assembly further comprises a flexible cover extending between the levitation rails that is at least partially transmissive of light and wherein at least one of the levitation rails is mounted for positioning in a closed position and an open position in which the at least one passenger may enter the vehicle.

9. The assembly of claim 1, wherein each set of magnetic elements comprises a plurality of permanent magnets linearly arranged and spaced apart less than about 0.125 inches from neighboring ones of the permanent magnets.

10. A ride assembly for use in providing amusement park guests a ride-through screen show experience, comprising:

a track defining a travel path for vehicles in a ride;

a screen assembly positioned transverse to the track separating the ride into first and second show portions, the screen assembly comprising two or more segments independently mounted for rotating each about a base edge; and a vehicle riding on the track for carrying one or more of the guests, wherein the vehicle is adapted to actuate the screen assembly to cause the screen segments to rotate about the base edges to allow the vehicle to pass through the screen assembly.

11. The assembly of claim 10, wherein the screen segments are each triangular in shape and include a roller in a tip section for contacting and rolling upon a roof of the vehicle.

12. The assembly of claim 10, wherein the screen segments each has a triangular body and include a permanent magnet in a tip section distal to the base edge and wherein the vehicle includes a number of series of permanent magnets positioned, proximate to an exterior surface to extend along the exterior surface such that each of the series of permanent magnets is aligned with one of the permanent magnets in the tip sections, with poles of the permanent magnets being oriented to provide magnetic levitation of the screen segments relative to the exterior surface of the vehicle.

13. The assembly of claim 12, wherein the triangular bodies are matching isosceles triangle with the tip sections being positioned proximate to each other in a closed position of the screen assembly and wherein the screen assembly includes at least four of the screen segments positioned side by side.

14. The assembly of claim 10, further comprising a projector projecting an image and wherein the screen segments comprise a projection surface for displaying the projected image.

15. The assembly of claim 10, wherein the vehicle comprises a body with an exterior surface with a plurality of levitation rails having a curved profile extending over a length of the vehicle body, wherein a plurality of magnets are positioned in the rails oriented with like poles facing outward, and wherein the screen segments each includes one or more magnets positioned to remain proximal to the magnets in a corresponding one of the levitation rails as the vehicle passes into and through the screen assembly, whereby mutually repelling magnetic forces cause the screen segments to float a distance over the vehicle body.

16. A vehicle and screen assembly for use in park rides, comprising:

a vehicle adapted for riding on a ride track with a body for seating one or more passengers, the vehicle further comprising a plurality of elongate and curved levitation rails on the body that each include a plurality of magnets with a same pole facing outward from the body; and a scenic element positioned across the ride track, wherein each of the scenic elements includes a magnet oriented with a pole matching the outward facing poles of the magnets in the levitation rails, whereby the magnets of the scenic elements and the magnets of a corresponding one of the levitation rails are positioned to be aligned to be proximal as the vehicle passes through the screen causing the scenic elements to be magnetically repelled a distance from the vehicle top assembly.

17. The assembly of claim 16, wherein the scenic element includes a plurality of screen segments with a projection surface for displaying projected images and wherein the screen segments are mounted for pivoting about a base and the magnets are positioned in an edge section distal to the base.

18. The assembly of claim 17, wherein the screen segments further comprise an additional projection surface opposite the projection surface and an additional magnet positioned behind the screen segment magnet with a like pole facing an opposite direction, whereby the vehicle may travel through and actuate the screen by traveling in both directions along the ride track.

19. The assembly of claim 16, wherein the magnets of the scenic elements and in the levitation rails are permanent magnets.

20. The assembly of claim 16, wherein the scenic elements are mounted for pivotal rotation and to be substantially in a common plane that is orthogonal to the ride track when in a path blocking position and wherein the scenic elements are further mounted to return to the common plane after the vehicle passes through the screen without further actuation.

* * * * *

UNITED STATES PATENT AND TRADEMARK OFFICE

CERTIFICATE OF CORRECTION

PATENT NO. : 7,905,790 B2
APPLICATION NO. : 12/204917
DATED : March 15, 2011
INVENTOR(S) : Schnuckle It is certified that error appears in the above-identified patent and that said Letters Patent is hereby corrected as shown below:

Column 3, line 22, delete “other The” and insert therefor --other--.

Signed and Sealed this
Twenty-first Day of June, 2011

David J. Kappos

David J. Kappos
*Director of the United States Patent and Trademark Office*